US006850145B1

(12) United States Patent
Kremers et al.

(10) Patent No.: US 6,850,145 B1
(45) Date of Patent: Feb. 1, 2005

(54) SELF-RECOVERING CURRENT-LIMITING DEVICE WITH LIQUID METAL

(75) Inventors: Wolfgang Kremers, Bonn (DE); Frank Berger, Swistal-Miel (DE); Andreas Kraetzschmar, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/890,503

(22) PCT Filed: Jan. 22, 2000

(86) PCT No.: PCT/EP00/00479

§ 371 (c)(1),
(2), (4) Date: Jun. 17, 2004

(87) PCT Pub. No.: WO00/46829

PCT Pub. Date: Aug. 10, 2000

(30) Foreign Application Priority Data

Feb. 1, 1999 (DE) ..... 199 03 837

(51) Int. Cl.[7] ..... H01H 87/00; H01H 29/02

(52) U.S. Cl. ..... 337/21; 337/119; 337/121; 337/167; 335/47; 335/49

(58) Field of Search ..... 337/21, 114, 119, 337/121, 122, 167; 335/47, 49, 50, 51, 57; 361/58; 29/622

(56) References Cited

U.S. PATENT DOCUMENTS

| | | | | | |
|---|---|---|---|---|---|
| 1,595,061 | A | * | 8/1926 | Valerius | 337/119 |
| 3,331,937 | A | * | 7/1967 | Harvey | 200/209 |
| 3,369,094 | A | * | 2/1968 | Langberg et al. | 337/154 |
| 3,381,248 | A | * | 4/1968 | Furth | 335/51 |
| 3,389,360 | A | * | 6/1968 | Keenan | 337/114 |
| 3,644,860 | A | * | 2/1972 | Yamagata et al. | 337/21 |
| 3,699,489 | A | * | 10/1972 | Imajyo | 337/21 |
| 3,806,855 | A | * | 4/1974 | Hurtle | 337/114 |
| 3,886,511 | A | * | 5/1975 | Miyamoto et al. | 337/119 |
| 3,902,150 | A | * | 8/1975 | Wada et al. | 337/116 |
| 3,991,396 | A | * | 11/1976 | Barkan | 337/114 |
| 4,429,295 | A | * | 1/1984 | Wu | 337/119 |
| 4,598,332 | A | * | 7/1986 | Kemeny | 361/58 |
| 5,471,185 | A | * | 11/1995 | Shea et al. | 335/51 |
| 5,581,192 | A | * | 12/1996 | Shea et al. | 324/722 |
| 6,525,642 | B1 | * | 2/2003 | Kremers et al. | 338/80 |

FOREIGN PATENT DOCUMENTS

| | | | | | |
|---|---|---|---|---|---|
| DE | 1024595 | | | 2/1958 | |
| DE | 1024595 | A | * | 2/1958 | H01B/1/08 |
| DE | 2353830 | | | 5/1974 | |
| DE | 2652506 | | | 5/1978 | |
| DE | 2652506 | A | * | 5/1978 | H01H/1/08 |
| DE | 4012385 | | | 3/1991 | |
| DE | 4012385 | A1 | * | 3/1991 | H01H/29/04 |
| GB | 1437102 | | | 10/1973 | |
| GB | 1538194 | A | * | 1/1979 | H01H/29/00 |
| GB | 2036443 | A | * | 6/1980 | H01H/1/06 |
| JP | 02100216 | A | * | 4/1990 | H01H/29/02 |
| SU | 922911 | A | * | 4/1982 | H01H/87/00 |
| SU | 922911 | | | 4/1982 | |
| SU | 1076981 | | | 2/1984 | |

* cited by examiner

*Primary Examiner*—Anatoly Vortman
(74) *Attorney, Agent, or Firm*—Davidson, Davidson & Kappel, LLC

(57) ABSTRACT

A self-recovering current-limiting device with a liquid metal includes a first and a second electrode for connection to an electric circuit to be protected. Each of the first and second electrodes are made of a solid metal. A plurality of pressure-resistant insulating bodies is provided, as well as a plurality of insulating intermediate walls supported by the insulating bodies. The plurality of insulating intermediate walls and the plurality of pressure-resistant insulating bodies define a plurality of compression spaces, and the plurality of insulating intermediate walls define a plurality of connecting channels. The plurality of compression spaces are disposed one behind the other between the first and second electrodes and are at least partially filled with the liquid metal. A first connecting conductor connected to the first electrode and disposed below the plurality of compression spaces and having an inverse current direction is provided, as well as a ferromagnetic body disposed above the plurality of compression spaces.

8 Claims, 1 Drawing Sheet

SELF-RECOVERING CURRENT-LIMITING DEVICE WITH LIQUID METAL

FIELD OF THE INVENTION

The present invention relates to a self-recovering current-limiting device with liquid metal, including two electrodes made of solid metal and a plurality of compression spaces partially filled with the liquid metal.

RELATED TECHNOLOGY

Soviet Union Patent Document SU 922 911 A describes a self-recovering current-limiting device containing electrodes made of solid metal which are separated by first insulating bodies which are designed as a pressure-resistant insulating housing. Inside the insulating housing, compression spaces are formed by insulating intermediate walls and second insulating bodies which are arranged therebetween and designed as ring-shaped sealing disks, the compression spaces being partially filled with liquid metal and arranged one behind the other and interconnected via connecting channels of the intermediate walls, the connecting channels being filled with liquid metal and arranged off-center. Thus, in normal operation, a continuous, inner conductive connection exists between the electrodes via the liquid metal. In the current-limiting event, the liquid metal is displaced from the connecting channels as a result of the high current density. In this manner, the electrical connection of the electrodes via the liquid metal is interrupted, resulting in the limiting of the short-circuit current. Subsequent to clearing or eliminating the short circuit, the connecting channels refill with liquid metal whereupon the current-limiting device is operational again. In German Patent Document DE 40 12 385 A1, a current-limiting device having only one compression space is described and vacuum, protective gas, or an insulating liquid are mentioned as the medium above the liquid level. According to Soviet Union Patent Document SU 1 076 981 A, the connecting channels of adjacent intermediate walls are staggered relative to each other for improving the limiting characteristics. It is known from German Patent Document DE 26 52 506 A1 to use gallium alloys, in particular GaInSn alloys in contact devices.

Because of the connecting channels arranged one behind the other in current-limiting devices featuring several compression spaces, a correspondingly high voltage drop is built up during the occurrence of a short circuit by the number of current-limiting partial arcs, the voltage drop finally interrupting the short-circuit current. However, the known current-limiting devices have too high a current-limiting factor, that is too high a ratio between the let-through current and the short-circuit current to be limited.

SUMMARY OF THE INVENTION

Therefore, an object of the present invention is to provide a current-limiting device with liquid metal, the current-limiting device having an improved current-limiting factor and response time.

The present invention provides a self-recovering current-limiting device including a liquid metal. The device includes a first and a second electrode for connection to an electric circuit to be protected, each of the first and second electrodes being made of a respective solid metal; a plurality of pressure-resistant insulating bodies; a plurality of insulating intermediate walls supported by the insulating bodies, the plurality of insulating intermediate walls and the plurality of pressure-resistant insulating bodies defining a plurality of compression spaces, the plurality of insulating intermediate walls defining a plurality of connecting channels, the plurality of compression spaces being disposed one behind the other between the first and second electrodes and being at least partially filled with the liquid metal; a first connecting conductor connected to the first electrode and disposed below the plurality of compression spaces and having an inverse current direction; and a ferromagnetic body disposed above the plurality of compression spaces.

The repulsive electromagnetic forces produced by the opposite current path flow in the first connecting conductor and in the liquid metal as well as the concentration of the magnetic field by the ferromagnetic body deviate the current path inside the current-limiting device in such a manner that, on one hand, an electric are developing the event of a short circuit is lengthened and, on the other hand, the pinch pressure arising in the case of higher currents gives rise to a quicker pinch-off of the current path in the region of the connecting channels. The magnetic forces which are decisive in the process are in square proportion to the current so that the described effect is negligible during nominal operation but the positive influence on the current-limiting behavior occurs in the range of the short-circuit currents. The described acting mechanism is self-acting, that is, it is based on the tripping action of a short-circuit current and of the resulting magnetic field.

Ferromagnetic materials having high to very high relative initial permeabilities can be used in an advantageous manner; mention should representatively be made of iron as well as of soft magnetic iron, cobalt or nickel alloys such as permalloy or mu-metal.

It is expedient for the desired concentration of the magnetic field if the ferromagnetic body extends over the total length of the compression spaces. It is advantageous for the first connecting conductor or for the ferromagnetic body to be secured and insulated by the pressure-resistant insulating bodies or by a part thereof. The lengthening of the arc is additionally increased by the staggered arrangement of the connecting channels.

It is advantageous to use a gallium alloy as the liquid metal. Especially GaInSn alloys are easy to handle because of their physiological harmlessness. An alloy of 660 parts by weight of gallium, 205 parts by weight of indium, and 135 parts by weight of tin is liquid from 10° C. to 2000° C. at normal pressure and possesses sufficient electrical conductivity.

BRIEF DESCRIPTION OF THE DRAWING

The present invention is elaborated on below based on exemplary embodiments with reference to the drawing, in which.

DETAILED DESCRIPTION

Figure 1:
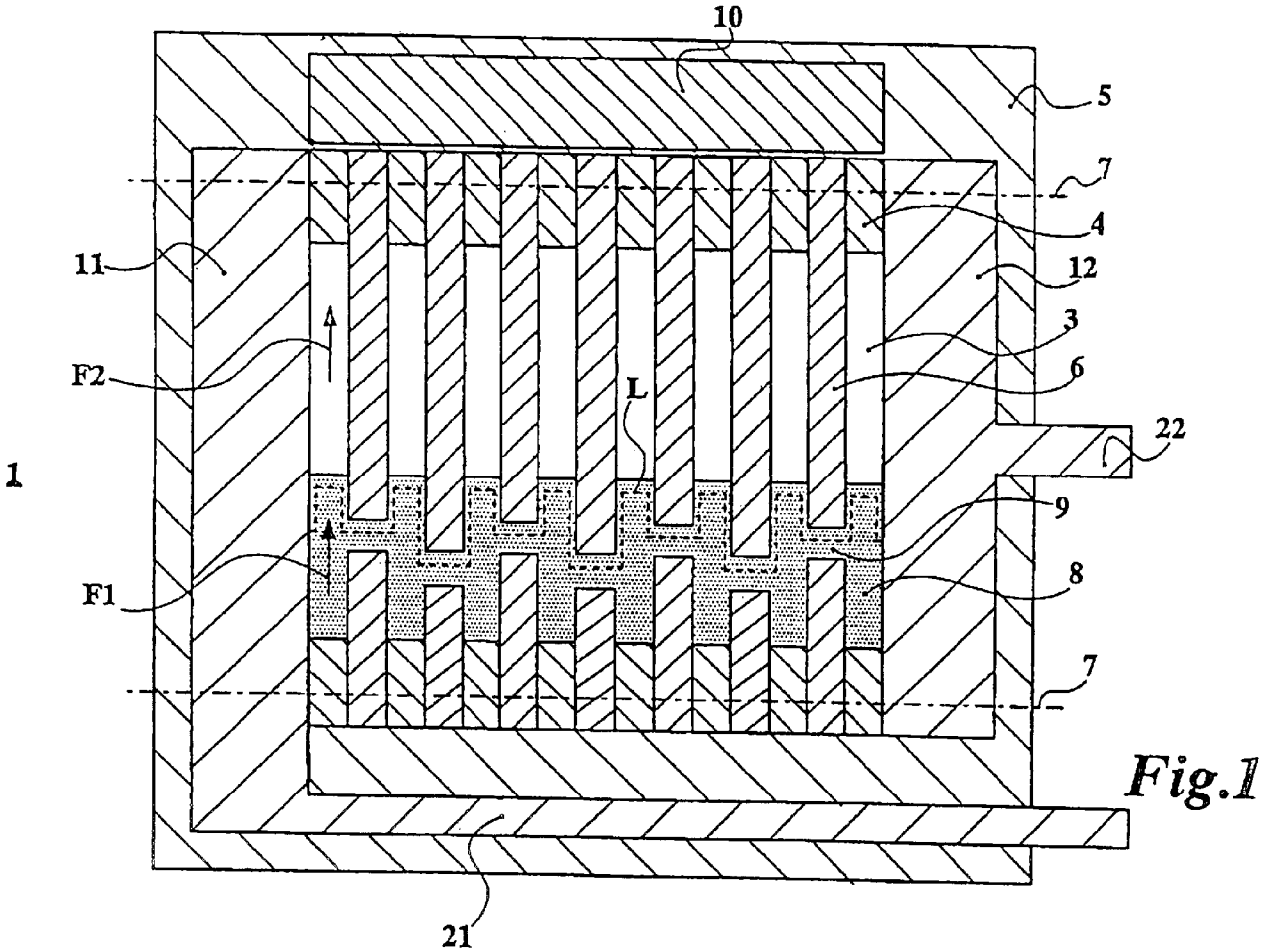
FIG. 1 shows a longitudinal section of a current-limiting device according to the present invention.

Single-pole current-limiting device 1 includes an electrode 11, 12 made of solid metal, preferably of copper, on each of the two sides, respectively, the electrode having a rotationally symmetrical design and merging into an outer connecting conductor 21, 22, respectively. Located between electrodes 11 and 12, are a plurality of compression spaces 3 which are formed by a corresponding number of ring-shaped sealing disks 4 and a corresponding number of insulating intermediate walls 6. Electrodes 11 and 12, sealing disks 4, and intermediate walls 6 are supported, by a molded housing 5, known devices being provided for sealing compression spaces 3 and frictionally connecting elements 11, 12, 4 and 6 which are supported in molded housing 5, however, the known devices not being shown for reasons of clarity. The device for sealing can be, for example, sealing rings between sealing disks 4 and intermediate walls 6 and electrodes 11, 12, respectively. The device for frictionally connecting can be, for example, continuous clamping bolts along the two lines 7. The two outer compression spaces 3 are each laterally bounded by one of electrodes 11 and 12, respectively, and by an intermediate wall 6. Inner compression spaces 3 are each laterally bounded by two intermediate walls 6. The generally multi-part molded housing 5 and sealing disks 4 are pressure-resistant first and second insulating bodies. All compression spaces 3 are at least partially filled with a liquid metal 8, for example, a GaInSn alloy. Located above liquid metal 8 is, for example, a vacuum. Intermediate walls 6 are provided with connecting channels 9 below the liquid level. Connecting channels 9 are also filled with liquid metal 8.

First connecting conductor 21 which belongs to left, first electrode 11 is run inside molded housing 5 beneath compression spaces 3 and exits molded housing 5 on the right side. Second connecting conductor 22 which belongs to right, second electrode 12 exits molded housing 5 on the right side as well. A ferromagnetic body 10 affixed in molded housing 5 extends above compression spaces 3. First connecting conductor 21 runs in such a manner that the current through liquid metal 8 and through second connecting conductor 22 is directed in the opposite direction, as a result of which a first electromagnetic force component F1 is exerted on the current in liquid metal 8. The action of the magnetic field influenced by ferromagnetic body 10 exerts a second electromagnetic force component F2 on the current in liquid metal 8. Both force components F1 and F2 are directed essentially upward but have no significant effect on the current in liquid metal 8 during the normal operation of current-limiting device 1. During the occurrence of an external short circuit, however, force components F1 and F2 increase to such an extent that the developing current-limiting electric arc is considerably deflected inside compression spaces 8 and thus lengthened. This condition is indicated by broken line L in FIG. 1. Due to the lengthened, meander-shaped course of the electric arc, the arc resistance increases to a considerable degree. Because of the thus reduced ratio of the let-through current to the triggering short-circuit current, an improved current-limiting factor is achieved via current-limiting device 1. The lengthening of the current-limiting electric arc is additionally promoted by the staggered arrangement of connecting channels 9 belonging to adjacent intermediate walls 6.

While a particular embodiment of the invention has been illustrated and described, modifications will become apparent to those skilled in the art, and it is intended to cover in the appended claims all such modifications as come with the scope of the invention. For example the current-limiting device may contain additional poles as described above with additional connecting conductors per pole so as to form a multi-pole current limiter.

What is claimed is:

1. A self-recovering current-limiting device including a liquid metal, the device comprising:

a first and a second electrode for connection to an electric circuit to be protected, each of the first and second electrodes being made of a respective solid metal;

a plurality of pressure-resistant insulating bodies;

a plurality of insulating intermediate walls supported by the insulating bodies, the plurality of insulating intermediate walls and the plurality of pressure-resistant insulating bodies defining a plurality of compression spaces, the plurality of insulating intermediate walls defining a plurality of connecting channels, the plurality of compression spaces being disposed one behind the other between the first and second electrodes and being at least partially filled with the liquid metal;

a first connecting conductor connected to the first electrode and disposed below the plurality of compression spaces and having an inverse current direction; and a ferromagnetic body disposed above the plurality of compression spaces.

2. The device as recited in claim 1 wherein the first and second electrodes are associated with a first pole of the device and further comprising a second and a third electrode associated with a second pole of the device.

3. The current-limiting device as recited in claim 1 wherein the ferromagnetic body includes a material having an initial permeability greater than 500.

4. The current-limiting device as recited in claim 1 wherein the ferromagnetic body extends substantially over a total longitudinal length of the plurality of compression spaces.

5. The current-limiting device as recited in claim 1 wherein the first connecting conductor is disposed inside at least a one of the plurality of insulating bodies.

6. The current-limiting device as recited in claim 1 wherein the ferromagnetic body is secured by at least a one of the plurality of insulating bodies.

7. The current-limiting device as recited in claim 1 wherein connecting channels of the plurality of connecting channels defined by adjacent intermediate insulating walls of the plurality of intermediate insulating walls are disposed in a staggered manner.

8. The current-limiting device as recited in claim 1 wherein the liquid metal includes a GaInSn alloy.

* * * * *